US007341529B2

(12) United States Patent
Bayduke

(10) Patent No.: US 7,341,529 B2
(45) Date of Patent: Mar. 11, 2008

(54) FOOTBALL TRAINING DEVICE

(76) Inventor: Ronald L. Bayduke, 181 Porter Dr., Akron, OH (US) 44319-4428

( * ) Notice: Subject to any disclaimer, the term of this patent is extended or adjusted under 35 U.S.C. 154(b) by 0 days.

(21) Appl. No.: 11/198,662

(22) Filed: Aug. 5, 2005

(65) Prior Publication Data

US 2005/0272534 A1 Dec. 8, 2005

Related U.S. Application Data

(63) Continuation-in-part of application No. 10/831,256, filed on Apr. 23, 2004, now Pat. No. 7,070,521.

(51) Int. Cl.
*A63B 69/00* (2006.01)
*A63B 63/00* (2006.01)

(52) U.S. Cl. ..... 473/439; 473/422; 473/438; 473/476

(58) Field of Classification Search ..... 473/422, 473/434, 435, 438, 439, 446, 454, 462, 476, 473/477; 273/348, 407, 410
See application file for complete search history.

(56) References Cited

U.S. PATENT DOCUMENTS

| | | | | | |
|---|---|---|---|---|---|
| 3,039,770 | A * | 6/1962 | Ferretti | 473/454 |
| 3,675,921 | A | 7/1972 | Meyer, Sr. | |
| 3,810,618 | A | 5/1974 | Nedwick | |
| 3,820,787 | A * | 6/1974 | Heinbigner | 473/439 |
| 4,160,549 | A * | 7/1979 | Simpson | 473/462 |
| 4,295,648 | A * | 10/1981 | Stromback | 473/456 |
| 4,936,578 | A * | 6/1990 | Hudson, Sr. | 473/439 |
| 5,160,138 | A | 11/1992 | Sanders | |
| 5,252,076 | A | 10/1993 | Kelleher | |
| 5,484,145 | A * | 1/1996 | Shriver | 473/454 |
| 5,527,185 | A | 6/1996 | Davis | |
| 5,584,480 | A * | 12/1996 | Grimsrud | 473/416 |
| 5,803,841 | A * | 9/1998 | Daskoski | 473/545 |
| 5,816,951 | A | 10/1998 | Hudock | |
| 6,093,120 | A * | 7/2000 | Luke, Jr. | 473/454 |
| 6,220,976 | B1 * | 4/2001 | Kaiser et al. | 473/476 |
| 6,398,672 | B1 * | 6/2002 | Olson | 473/439 |
| 6,620,065 | B2 * | 9/2003 | Clabough | 473/454 |
| 6,679,795 | B2 | 1/2004 | Ouimette et al. | |
| 7,070,521 | B2 * | 7/2006 | Bayduke | 473/438 |
| 7,090,596 | B2 * | 8/2006 | David | 473/439 |
| 2002/0132685 | A1 * | 9/2002 | Fusco | 473/454 |
| 2006/0237913 | A1 * | 10/2006 | Giske et al. | 273/402 |

* cited by examiner

*Primary Examiner*—Mitra Aryanpour
(74) *Attorney, Agent, or Firm*—Hudak, Shunk & Farine Co. LPA

(57) ABSTRACT

A device which is utilized during practice or other informal situation to teach a football player such as a quarterback or kicker to deliver a football around or over one or preferably a group of linemen. In one embodiment, the device includes a mechanism capable of moving at least one figure, simulative of a human athlete, from an inactive position to an active position which is adapted to mimic predetermined characteristics of a defensive line. In yet a further embodiment, the training device has a gate of a predetermined height and width operatively connected to a base which can be utilized, for example, to practice throwing, snapping, or hiking the football, or the like. In another embodiment, the training device includes a backstop, such as a net, which can be utilized to stop a football used with the training device, such as during practice of a snap, a kick, a throw or a punt.

15 Claims, 11 Drawing Sheets

FOOTBALL TRAINING DEVICE

CROSS REFERENCE

This application is a continuation-in-part of U.S. Ser. No. 10/831,256 filed Apr. 23, 2004 now U.S. Pat. No. 7,070,521, entitled "Football Training Device".

FIELD OF THE INVENTION

The present invention relates to a football skills training device which is utilized during practice or other informal situation to teach a football player such as a quarterback or kicker how to deliver a football around or over at least one and preferably a group of defensive linemen. In one embodiment, the device includes two or more figures, each simulative of a human athlete which are each operatively connected to and height adjustable on a base. In a further embodiment, the training device includes a mechanism capable of moving at least one figure from an inactive position to an active position which is adapted to mimic predetermined characteristics of a defensive line.

In yet a further embodiment, the training device has a gate of a predetermined height and width operatively connected to a base which can be utilized, for example, to practice throwing, snapping, or hiking the football, or the like. In another embodiment, the training device includes a backstop, such as a net, which can be utilized to stop a football used with the training device, such as during practice of a snap, a throw, a kick or a punt.

BACKGROUND OF THE INVENTION

The game of football requires coordination between mental and physical skills. In order to improve these skills, players are subjected to numerous practice sessions generally in a formalized setting in order to learn new or different techniques or procedures.

It is often desirable for a quarterback or kicker to practice against a scout team having a defensive line which mimics an upcoming opponent in order to become better prepared or accustomed to what is likely to happen in a real game situation. Often times players will be injured during the noted practice sessions. For obvious reasons, it would be desirable to prevent injuries to team players during practice.

Furthermore, often times it is not possible to assemble a scout team which has the same height and width characteristics for a player in each position in order to simulate the upcoming opponent. It would be desirable for a football player, especially a quarterback or kicker to practice against the best "look" of an opponent, utilizing the same formation, as well as having the same or similar height and width dimensions of the opponent.

U.S. Pat. No. 3,810,618 relates to an apparatus for developing skill in playing football, the device consisting of a target game unit and a training unit which are detachably attached together; and in which the training unit includes a pair of upstanding frames mounted upon caster wheels so to be movable across the ground, the frames supporting several simulated player rusher's consisting of a fabric sheet stretched on a depending frame and the sheet having slits; and the target game unit consisting of netting pockets formed on a fabric sheet supported along its edges by tension springs from a tubular metal frame provided with means for being retained in an erect position while players toss a ball or the like into the pockets.

U.S. Pat. No. 5,252,076 relates to an apparatus for training athletes to reportedly improve their ability to concentrate on, track, and handle or catch a ball in motion with at least one central elongated body, a plurality of barrier arms for each elongated body with the barrier arms extending outward from and being arrayed along the central elongated body, and a mounting system for each central elongated body that is attached to and holds each central elongated body upright in substantially vertical position without the use of external supports. Barrier arms are made of flexible material.

U.S. Pat. No. 5,816,951 relates to a sports training device, which is a simulated human figure having at least one movable limb; a fluid-containing actuating system connected to the movable limb; and a trigger device connected to the fluid-containing actuating system, for activating the fluid-containing actuating system. The training device reportedly provides a distractive movement to acclimate the sports player to distractions.

U.S. Pat. No. 5,527,185 relates to an athletic training device comprising a base, an upright supported by the base, and a planar training shape simulative of a human athlete, including head, torso, arms and legs, mounted on said upright. The vertical height of the training shape is adjustable, and the arms articulate at the elbows and shoulders so that the position of the arms is adjustable. The training shape will remain at a predetermined height with the arms in a predetermined posture, so that the training device will represent an opponent at the posture and position for which the ball handler seeks to develop the countermove. Once the simulated opponent is countered at a first position and height, the height of the opponent can be raised.

SUMMARY OF THE INVENTION

A football training device is provided which is adapted to simulate a defensive line in order to acclimate a quarterback, kicker or other players to various characteristics of an opponent. The device is used to teach the quarterback, etc. how to maneuver a football over or around the figures of the device simulating the defensive line.

In a further embodiment of the present invention, the training device includes a target or gate of a predetermined height and width connected to a base adapted to be in contact with a ground surface. The training device including the target or gate can be utilized to practice snapping, punting, kicking, passing, or the like. In a further embodiment, a backstop or net device is operatively connected to the training device at a location behind the target or gate, generally parallel to the width of the target, in order to stop or knock down a football directed, i.e. kicked, thrown, or the like, at the gate. In a preferred embodiment, a portion of the backstop is directly connected to the base of the device.

In one embodiment the device includes one or more figures connected to a base, with the figures individually adjustable in height, etc. In a further embodiment, the one or more figures are connected to a rotatable member operatively connected to the base. The figures are movable from a down, inactive position to an upright, active position which is adapted to mimic a defensive line formation after the football is snapped from center.

It is an object of the present invention to provide a sports training device which is relatively inexpensive, mechanically simple and lightweight which is readily affordable by most football teams including college and high school teams.

It is a further object of the present invention to provide a training device which improves a quarterback, punter, or kicker's timing and/or ability to maneuver a ball over or through holes in a defensive line.

It is another object of the invention to provide a practice and training device which can be utilized by all three main components of a kicking game, including the center or snapper, holder, and kicker, individually, or in combinations thereof.

Another object of the present invention is to provide a training device which is able to stop or knock down a football and keep the same in a defined practice area.

It is also an object of the present invention to provide a training device which minimizes injuries occurred during practice.

It is a further object of the present invention to provide a training device that is easily moved from one location to another.

It is yet another object of the present invention to provide a training device which allows training drills to be performed in a repeatable manner.

The present invention achieves these and other objectives which will become apparent from the description that follows.

BRIEF DESCRIPTION OF THE DRAWINGS

The invention will be better understood and other features and advantages will become apparent by reading the detailed description of the invention, taken together with the drawings, wherein.

DETAILED DESCRIPTION OF THE INVENTION

Figure 1:
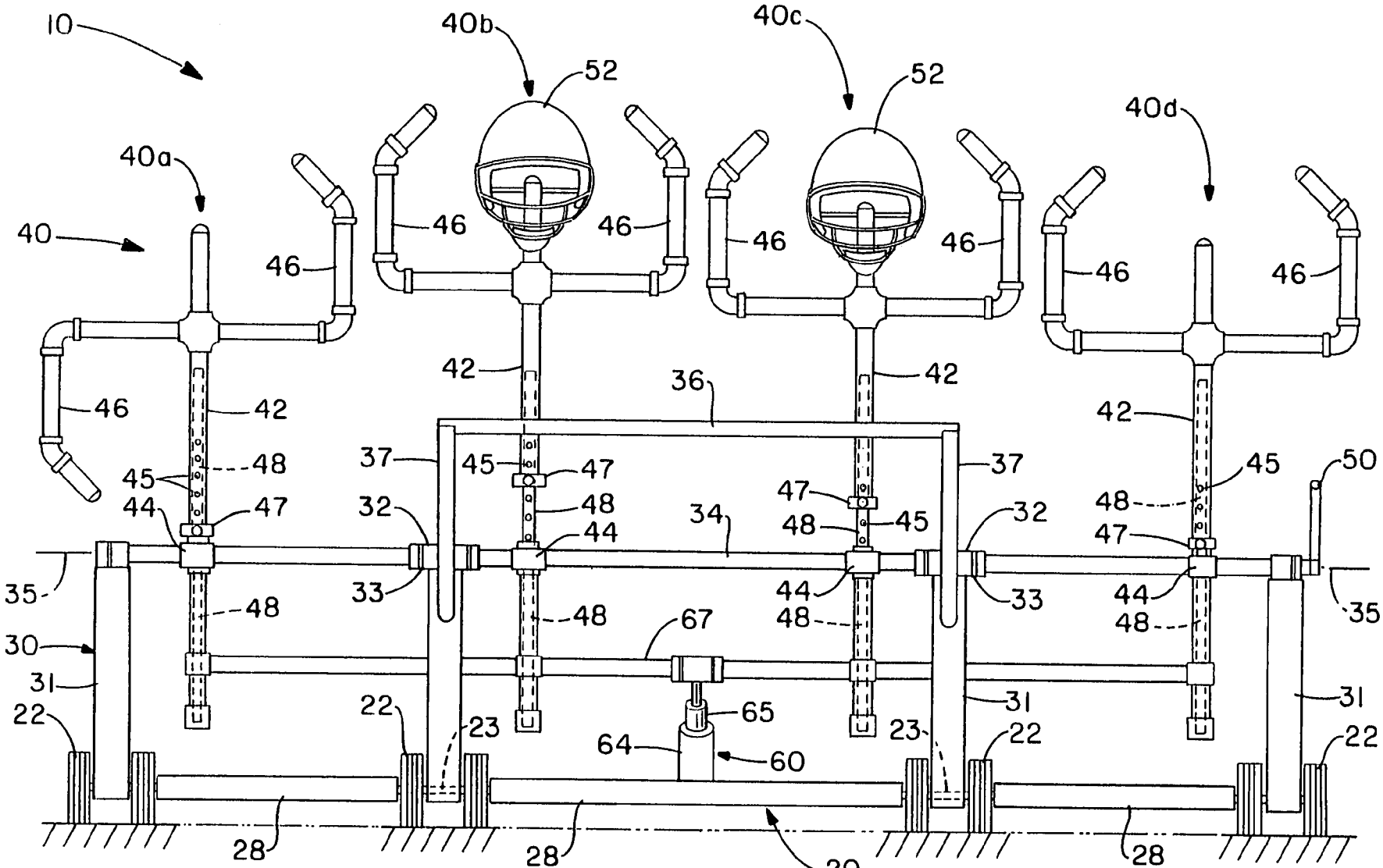
FIG. 1 is a front elevational view of one embodiment for a football training device in accordance with the present invention.

This description of preferred embodiments is to be read in connection with the accompanying drawings, which are part of the entire written description of this invention. In the description, corresponding reference numbers are used throughout to identify the same or functionally similar elements. Relative terms such as "horizontal," "vertical," "up," "down," "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and are not intended to require a particular orientation unless specifically stated as such. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship.

Figure 2:
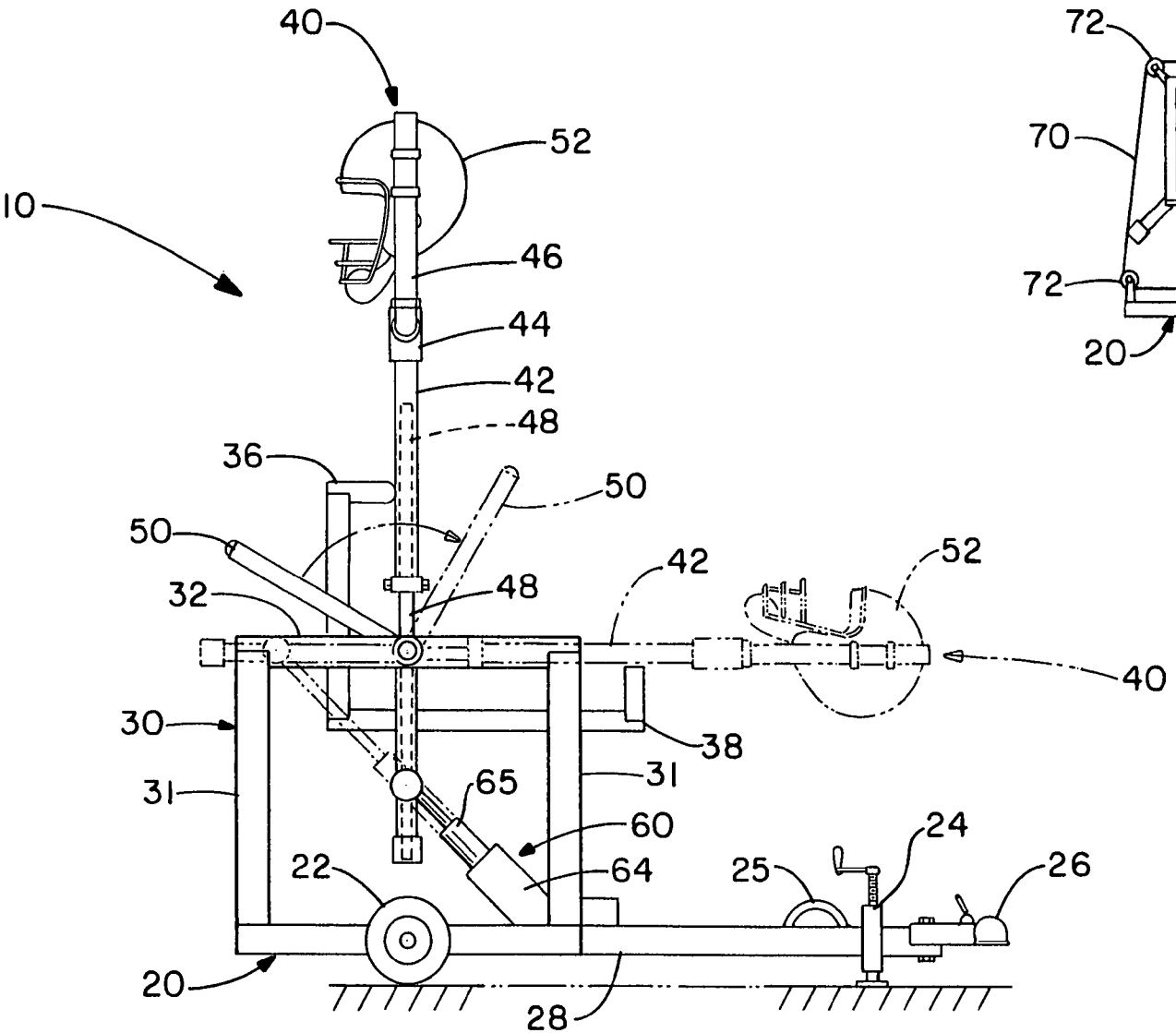
FIG. 2 is a right side elevational view of the device shown in FIG. 1 with a player figure shown in a raised height and upright active position, and also shown in a lower inactive position via ghost lines.
Figure 3:
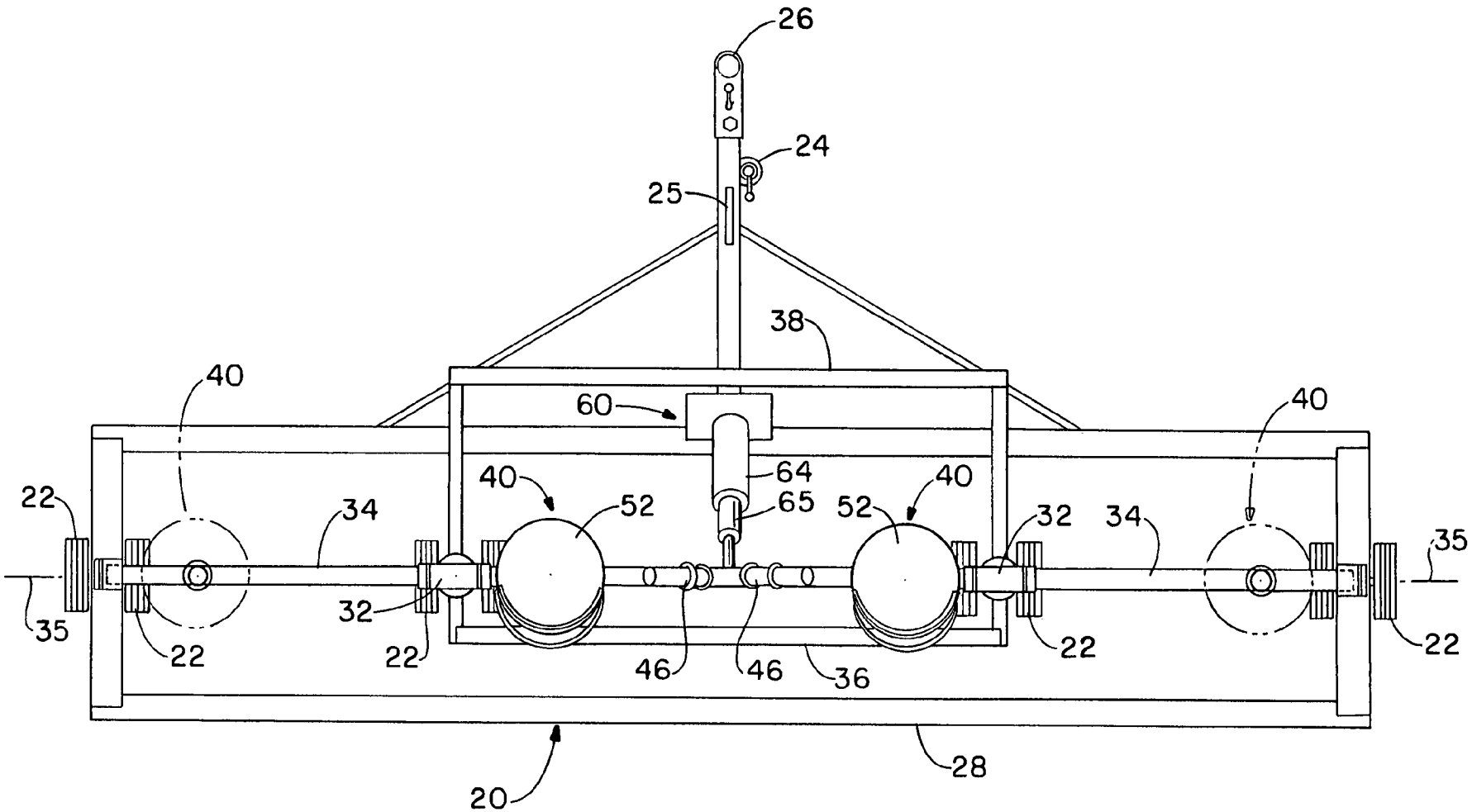
FIG. 3 is a top view of the device shown in FIG. 1 with portions broken away and other portions shown in ghost lines.

With reference now to the drawings, particularly FIGS. 1, 2, and 3, training device 10 includes base 20 which is adapted to contact a ground surface and provide stability to the remaining portions of the training device 10. Base 20 is constructed of one or more base beams 28 which are arranged and connected to provide a sturdy frame for the movable simulated human player FIG. 40. In one embodiment, base beams 28 or other structure or portion of the base is adapted to contact the ground. In a further embodiment, base 20 is provided with two or more wheels 22 rotatably journaled in axles 23 to provide rolling mobility to training device 10. FIG. 3 shows axles 23 operatively connected to beam 28 connected to one or more additional beams 28 or other fittings which collectively form a box-like frame. In many embodiments, the base 20 has an elongated structure in order to house, support and/or stabilize the plurality of simulated player FIG. 40 adapted to resemble a defensive line. In a preferred embodiment, from about 2 to about 10 wheels 22 and preferably six wheels 22 are operatively connected to the frame, preferably in pairs. Four pairs of wheels 22 are shown in at least FIG. 3. As illustrated in FIG. 2, in one embodiment hitch 26 is connected to base 20 in a suitable location such as at a rear end, so that the training device can be trailered by a car, truck, golf cart, or other towing vehicle. The training device 10 is relatively light in weight and can even be moved by a person, such as with handle 25. In this manner, the training device 10 is easily moved to generally any desired area and positioned on a practice field or other location. A telescoping ground contacting member 24 is provided in a preferred embodiment. Ground contacting member 24 can include a jack which is utilized to raise or lower the rear portion of the training device in order to level the base 20. FIG. 3 illustrates a top view of a preferred embodiment for a base configuration of the training device 10 of the present invention. The rotatable FIG. 40 are situated on the frame so a weight balance, between the front and rear portions, of the frame is substantially attained.

Figure 4A:
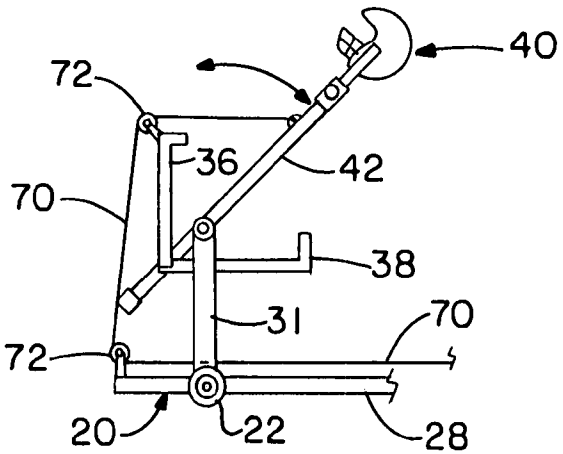
FIG. 4A-4B illustrates various activating mechanisms which may be applied to the device for moving player figures from an inactive lowered position to an active upright position.

Base 20 further includes one or more support members 30 connected to beam 28 or other structure of base 20. The support member 30 generally includes an upright substantially vertical section 31 and a cross section 32 connected to vertical section 31 in which rotatable member 34 is journaled and rotatable. Cross section 32 is generally substantially horizontally oriented. In a preferred embodiment, a vertical section is utilized to support each end of vertical section 31 as illustrated in FIG. 2 preferably through an appropriate fitting or connection. The support member 30 is substantially inverted "U" with the open ends of the "U" connected to base 20. In an alternative embodiment, the support member 30 is essentially straight with cross section 32 connected to the upper end of vertical section connected to base beams 28 as illustrated in FIG. 4A. A sufficient number of support members 30 are utilized so that FIG. 40 are adequately supported and allowed to perform their intended function, i.e., are free to rotate or move from a first position to at least a second position. Generally at least one support member 30 is used per FIG. 40 present in the device 10. The number of support members 30 generally ranges from 1 to about 20, desirably from about 2 to about 12, and preferably from about 6 to about 10 per device 10. FIG. 3 shows that a support member 30 is utilized on each side of simulated FIG. 40 to provide a strong, rigid frame. The extension or length of the support member in a vertical direction is sufficient so that the rotatable cross section 32 is located a predetermined distance from the bottom of base 20 or a ground surface. The support member 30 has a vertical length that ranges generally from about 6 to about 60 inches, desirably from about 8 to about 48 inches, and preferably from about 12 to about 36 inches.

Rotatable shaft member 34, rotatably journaled or operatively connected in the one or more support member 30 cross sections 32, is preferably substantially cylindrical with respect to the direction around the shaft axis of rotation 35, at least in the area of contact with cross section 32. When two or more support members 30 are utilized such as shown in FIGS. 1 and 3, the support member cross sections 32 have rotatable member housing portions which are aligned in relation to each other so that the axis of rotation 35 extends therethrough. Accordingly, rotatable member 34 extends a predetermined distance along axis of rotation 35. In some embodiments, bearings 33 are utilized to insure smooth rotation of rotatable member 34 in cross section 32.

As described hereinabove, one or more simulated human FIG. 40 are adjustably connected to rotatable member 34 in order to simulate the characteristics of an opposing line, preferably a defensive line. Four FIGS. 40*a-d* are shown in FIG. 3. That said, the number of simulated FIG. 40 utilized in training device 10 ranges generally from about 1 to about 11, desirably from about 2 or 3 to about 9, and preferably from about 6 to about 8.

The rotatable member 34 is formed from one or more individual pieces fastened in some manner through a suitable fastener or fitting and has an overall length generally from about 3 to about 40 feet, desirably from about 6 to about 35 feet, and preferably from about 18 to about 30 feet in order to accommodate the predetermined number of FIG. 40. One or more figure connection members 44 are present on and connected to rotatable member 34 in order to attach FIG. 40 thereto. The figure connection members 44 are spaced a predetermined distance from each other in order to accommodate the FIG. 40 to be utilized in the training device 10. The distance between consecutive connection members 44 ranges generally from about 12 or about 24 to about 60 inches, desirably from about 36 to about 48 inches, and preferably about 44 inches.

Simulated human FIG. 40 includes a main body 42 operatively connected to inner tube or figure extension 48 having one or more and preferably a plurality of aperture(s) located thereon. FIG. 40 is operatively connected to figure connection member 44 of rotatable member 34 through figure extension 48. Each main body 42 has a vertical length which ranges from about 12 to about 48 inches, desirably from about 18 to about 46 inches, and preferably from about 24 to about 42 inches. Main body 42 has a rotatable collar 47 connected to the lower end thereof which is connected to an aperture 45 of inner tube or figure extension 48. Figure extension 48 of FIG. 40 includes generally from about 1 to about 20 apertures, desirably from about 2 to about 15 apertures, and preferably from about 8 to about 12 apertures in order to provide a predetermined height to FIG. 40 in an up position as shown in FIG. 1. The apertures can be spaced from each other at increments of about 0.5, 1, 2, 3, 4 or 6 inches or the like. Tube 48 has a length generally from about 24 to about 60 inches, desirably from about 36 to about 56 inches, and preferably about 54 inches. Lower end of figure extension 48 rests against the lower portion of an extension figure connection member 44. FIG. 40 in some embodiments also includes one or more arms 46 which are optionally movable from a down position to a raised position and are connected to main body 42, see FIG. 1. If desired, a football helmet can be attached to the upper portion of main body 42 utilizing any suitable fastener such as screws, nuts, bolts or the like. Each FIG. 40 individually has a greatest overall vertical height (i.e., top of helmet if present as in 40*b* and 40*c* of FIG. 1) measured from a ground surface or the bottom of base 20 of generally from about 4 feet to about 7 feet, desirably from about 5 feet to about 6 feet 10 inches, and preferably from about 5 feet 6 inches to about 6 feet 8 inches in an upright position as shown in FIG. 1. Thus, each FIG. 40 simulates a football player of a predetermined height. FIG. 40 tube or figure extension 48 is connected to figure connection member 44 and a fastener is inserted through aperture 45 of spin collar 47 connected to main body 42 to operatively secure FIG. 40 to rotatable member 34. In a preferred embodiment, the spin collar is utilized so that FIG. 40 main body 42 can be turned or rotated on an axis perpendicular to rotational axis 35 while the collar 47 remains fixed to figure extension 48. In some embodiments collar 47 does not spin. The ability of the body 42 to turn or spin aids in absorbing shock or energy transferred to the figure when hit by a football. If desired, main body 42 of FIG. 40 can be directly connected to connection member 44 of rotatable member 34.

In one embodiment as illustrated in FIGS. 1-3, an activation mechanism 60 is utilized to move rotatable member 34 from a first position to a second position. A piston cylinder assembly or actuator is illustrated in at least FIGS. 1 and 3 having a first end operatively connected to base 20 such as through base beam 28 or a platform connected thereto and a second end operatively connected to rotatable member 34 in order to pivot FIG. 40 from a first position to at least a second position. In one embodiment, the piston cylinder is pneumatically or hydraulically operated. Numerous piston cylinder assemblies or actuators are known in the art and are commercially available from sources such as Norgren of Littleton, Colo. as the "Roundline" series, or Parker Hannifin of Des Plaines, Ill. as the SR series. As illustrated in FIG. 1, cylinder base 64 is connected to base member 28 and a moveable connecting rod 65 is connected to connecting bar 67 which is in turn connected to an extension of rotatable member 34, i.e., figure connection member 44. When the piston cylinder assembly is activated, the rotatable member is rotated about axis 35 thereby rotating any FIG. 40 connected thereto. If desired, a plurality of piston cylinder assemblies can be connected at various locations along the frame in order to rotate FIG. 40.

As illustrated in FIGS. 1 and 2, in an alternative embodiment the activating mechanism 60 is a lever 50 which is affixed to a suitable location on rotatable member 34 such as an end thereof. As illustrated in FIG. 2, the lever has a lower end connected to rotatable member 34 and is oriented at a predetermined angle with respect to horizontal and has a predetermined length to provide ease of use for a person manipulating the training device. With the FIG. 40 in a down position and substantially horizontal resting against stop 38, the lever is preferably situated at a predetermined angle with respect to horizontal as illustrated in FIG. 2. When the lever is rotated in a counterclockwise position, the rotatable member 34 is rotated and the FIG. 40 attached thereto are moved from a first position in this case, the down, inactive position to an up, active position which is substantially vertical, with a portion of the FIG. 40 resting against up position bumper 36. FIG. 40 can be rotated with rotatable member 34 to a plurality of positions, preferably between down stop 38 and bumper 36, utilizing any activating mechanism. Of course, it is understood that stop 38 and bumper 36 may be omitted or modified in order to provide additional or less range of movement for FIG. 40.

Figure 4B:
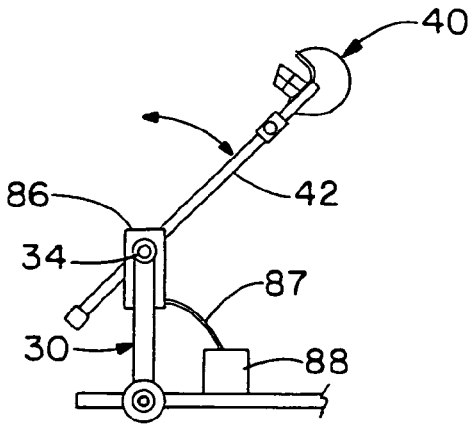
Figure 5:
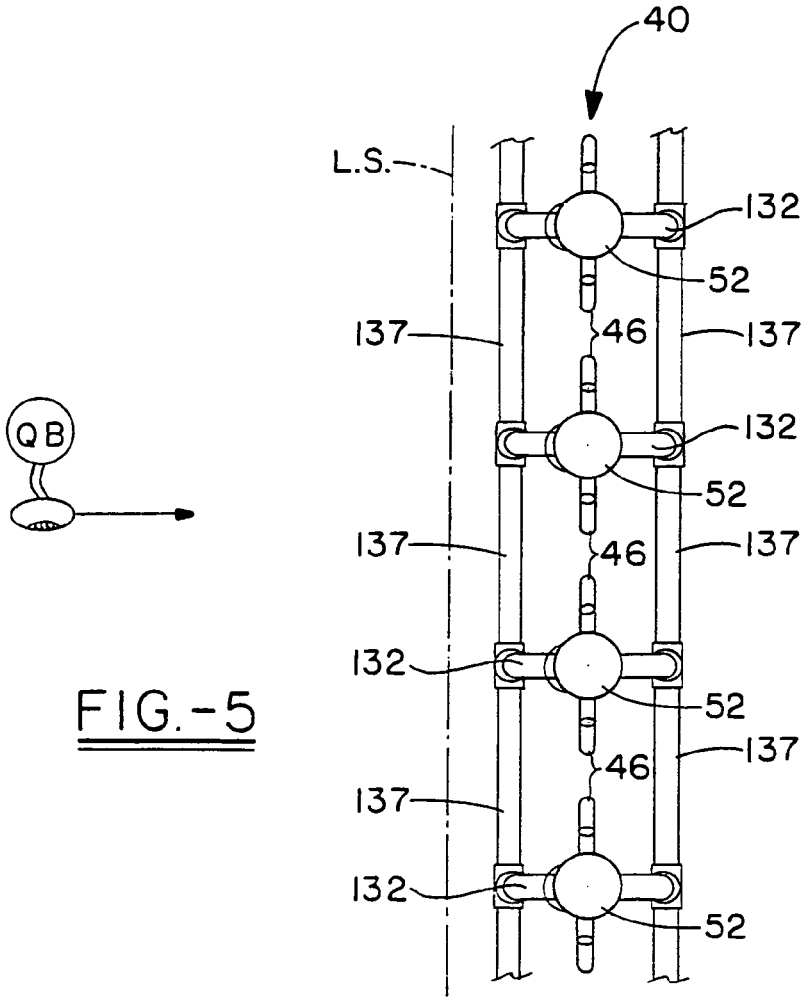
FIG. 5 illustrates the device of the invention, configured as in FIGS. 6 and 7, as it may be used in a football training exercise.

Additional activating mechanisms 60 are contemplated as shown in FIGS. 4A and 4B. FIG. 4A illustrates an alternative activating mechanism for the training device 10 of the present invention. As illustrated, cable 70 is attached to a figure main body 42 or other structure rotatably attached to rotatable member 34 and routed through one or more pulleys 72 connected to the training device 10 such as in location such as bumper 36 and along base beam 28 as illustrated in FIG. 4A. In order to raise FIG. 40, cable 70 is pulled so that FIG. 40 is rotated to an appropriate active position. A spring and trigger mechanism can also be utilized in conjunction with cable 70, wherein a trigger lock will maintain the figure in a down position until a trigger is activated whereby a spring force release rotates the FIG. 40 from a down to an up position.

FIG. 4B illustrates a further embodiment of a suitable activating mechanism utilized in the training device 10 of the present invention. Therein, servo 86 is fixedly connected to a bearing section 30 of the base other non-rotating structure of training device 10. Servo 86 has an operating portion connected to rotatable member 34 such as at end thereof as shown in FIG. 4B. Control apparatus 88 or electronic controller is connected to servo 86 by any suitable means such as wiring 87. Control apparatus or electronic controller 88 activates servo 86 which rotates rotatable member 34 and FIG. 40 attached thereto.

Figure 7:
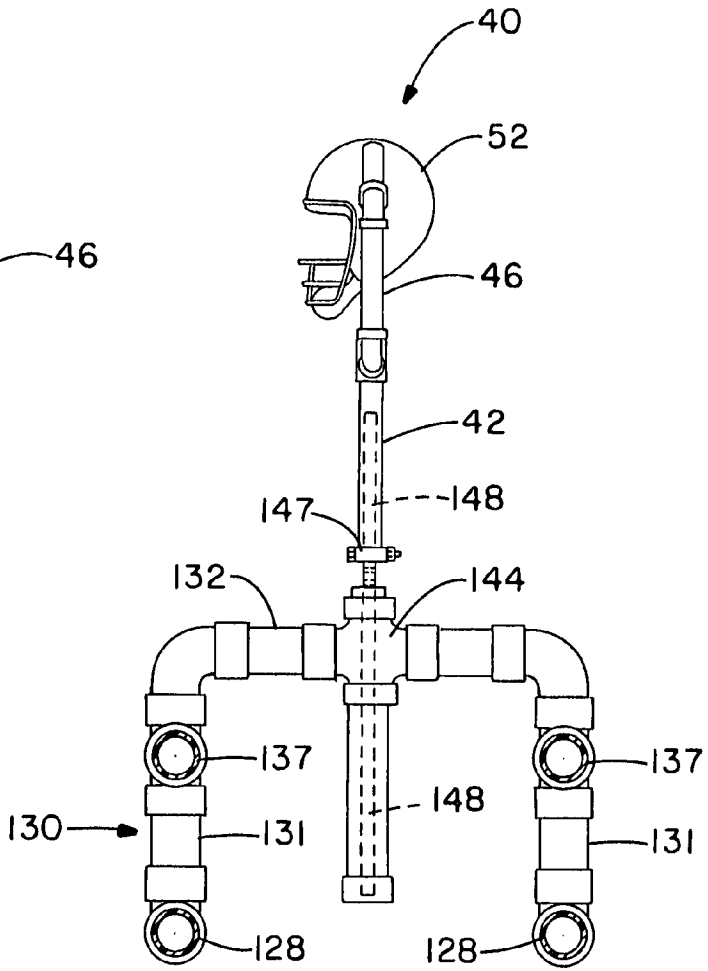
FIG. 7 is a cross sectional side view of the embodiment of FIG. 6 of the present invention wherein the figures are maintained in a stationary upright position.
Figure 6:
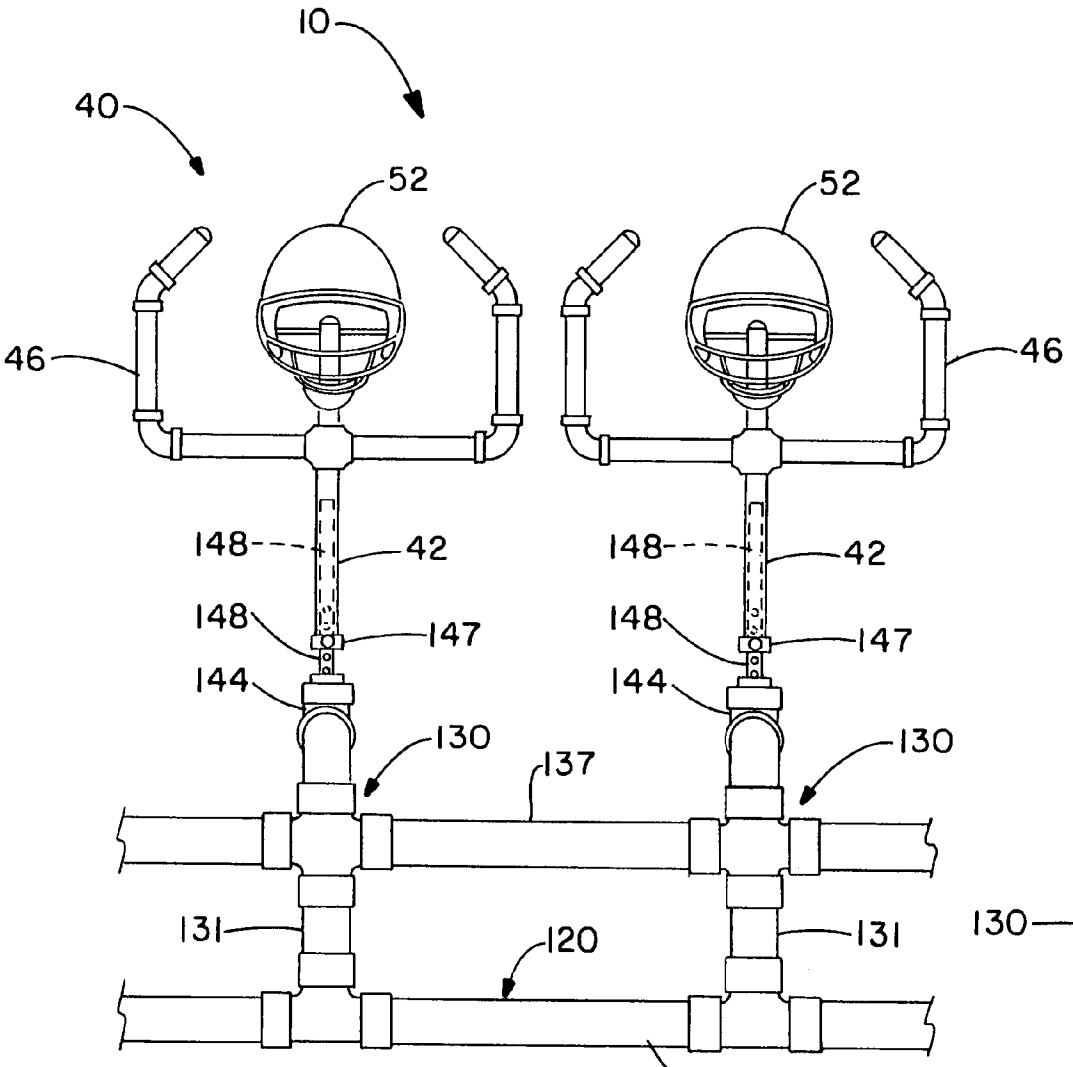
FIG. 6 is a partial front view of a further embodiment of the present invention wherein the figures are maintained in a stationary upright position.

In yet another embodiment of the present invention, training device 10 is provided with one or more, and preferably a plurality of FIG. 40 as described hereinabove and incorporated by reference which are fixed in a substantially upright position as illustrated in FIG. 6. The base 120 is formed substantially similar to the previously described embodiment and comprises base members 128 connected to one another to form a sturdy, rigid frame. If desired, the above-noted wheels can be connected to base members 128 through an axle or other suitable portion of base 120. One or more support members 130 of base 120 each have a substantially vertical section 131 in a substantially horizontal cross section 132 generally having a first end connected to a first vertical section 131 and a second end connected to a second vertical section 131 as illustrated in FIG. 7. As illustrated in FIGS. 6 and 7 frame rails 137 are utilized to connect one or more adjacent support members 130 to provide additional strength to device 10. Horizontal section 132 includes a figure connection section 144 to which FIG. 40 is operatively connected. FIG. 40 is preferably connected to figure connection section 144 through tube or figure extension 148. As described hereinabove, figure extension 48 includes a predetermined number of apertures to allow FIG. 40 to be connected at a plurality of different heights. Collar 147 has an aperture therein for allowing a portion of FIG. 40 to be connected to tube 48 and operatively connected to base 20. Collar 147 is preferably a spin collar which allow FIG. 40 to rotate in a clockwise or counterclockwise position when viewed from above. FIG. 40 is operatively connected to support member 130 of base 120, preferably as described hereinabove and incorporated by reference.

The training device 10 of the present invention can be constructed from generally any suitable materials including wood, metal, and plastic, or a combination thereof. In a preferred embodiment, the training device is constructed from a durable plastic material, either a thermoplastic or thermoset. In one embodiment, polyvinyl chloride or chlorinated polyvinyl chloride, or a combination thereof is utilized to form the base beams 28, support member 30, rotatable member 34, figure connection member 44, and at least portions of FIG. 40. In one embodiment, the base, rotatable member 34 and FIG. 40 are constructed utilizing schedule 40 or schedule 80 polyvinyl chloride or chlorinated polyvinyl chloride piping and fittings. In a further embodiment, the training device 10 is constructed from materials comprising PVC and/or aluminum, or combinations thereof.

Figure 8:
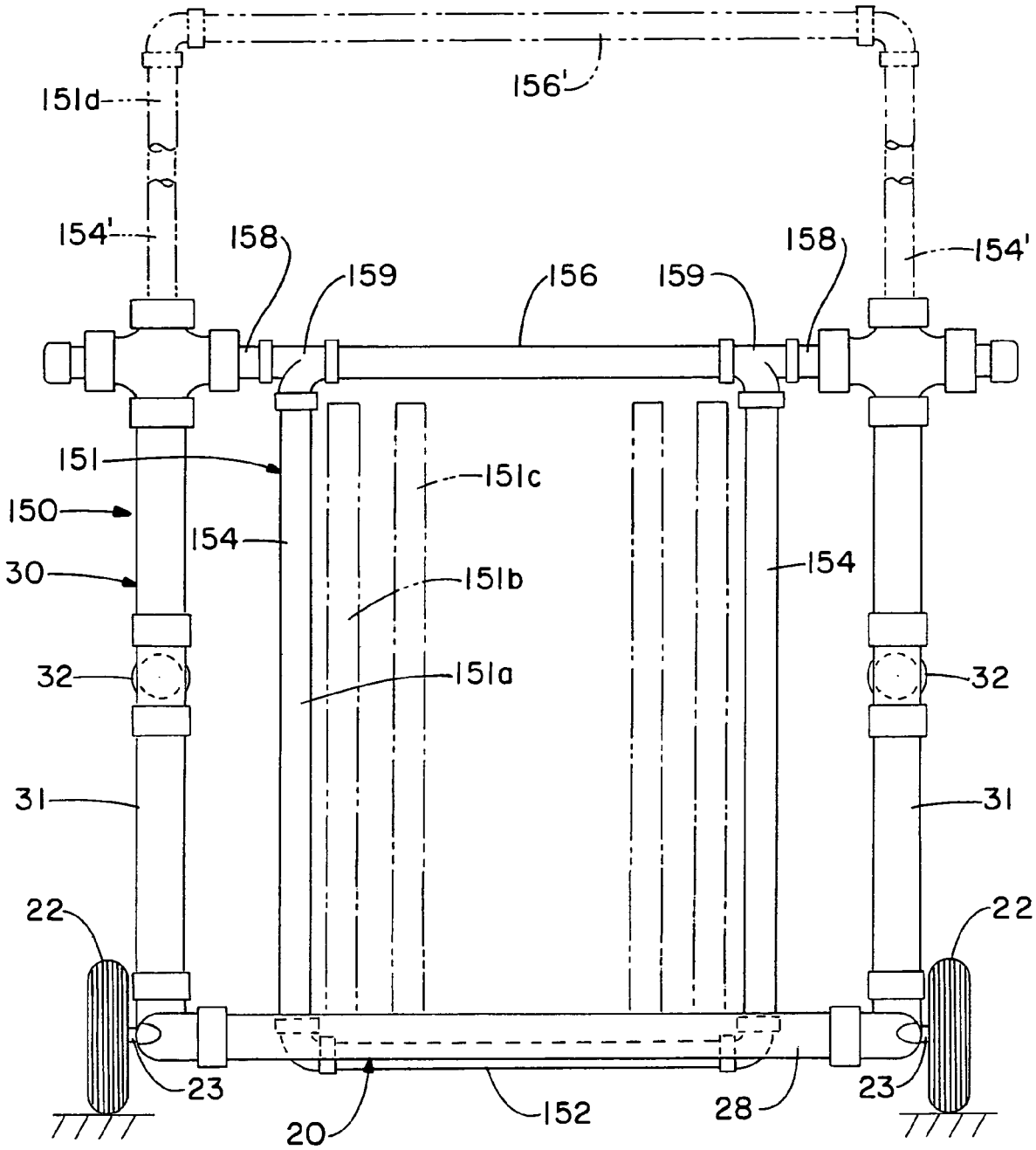
FIG. 8 is a front elevational view of one embodiment of a football training device having a practice target or gate for snapping, with alternate gate configurations being shown in phantom lines.
Figure 9:
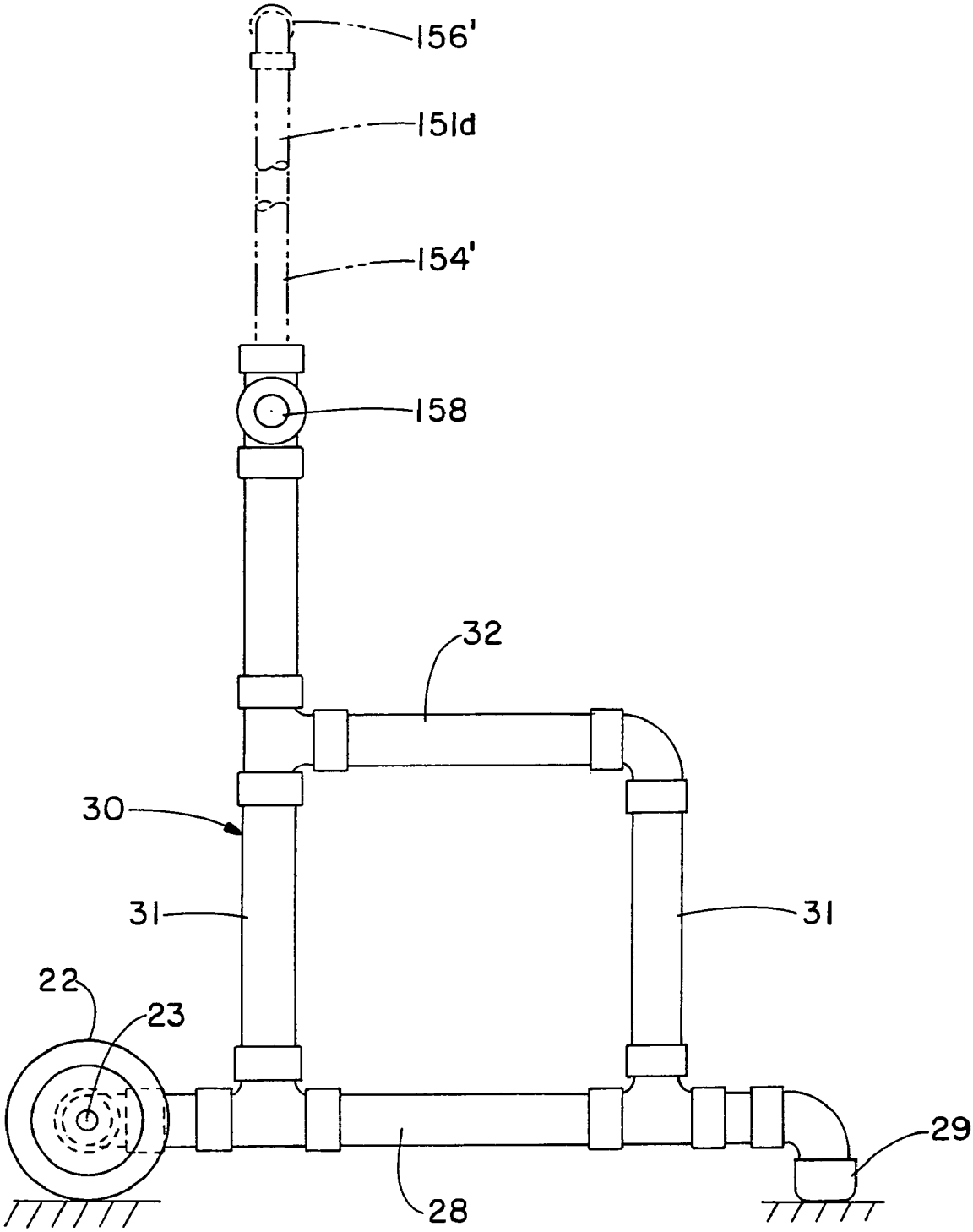
FIG. 9 is a side view of the embodiment of FIG. 8.
Figure 10:
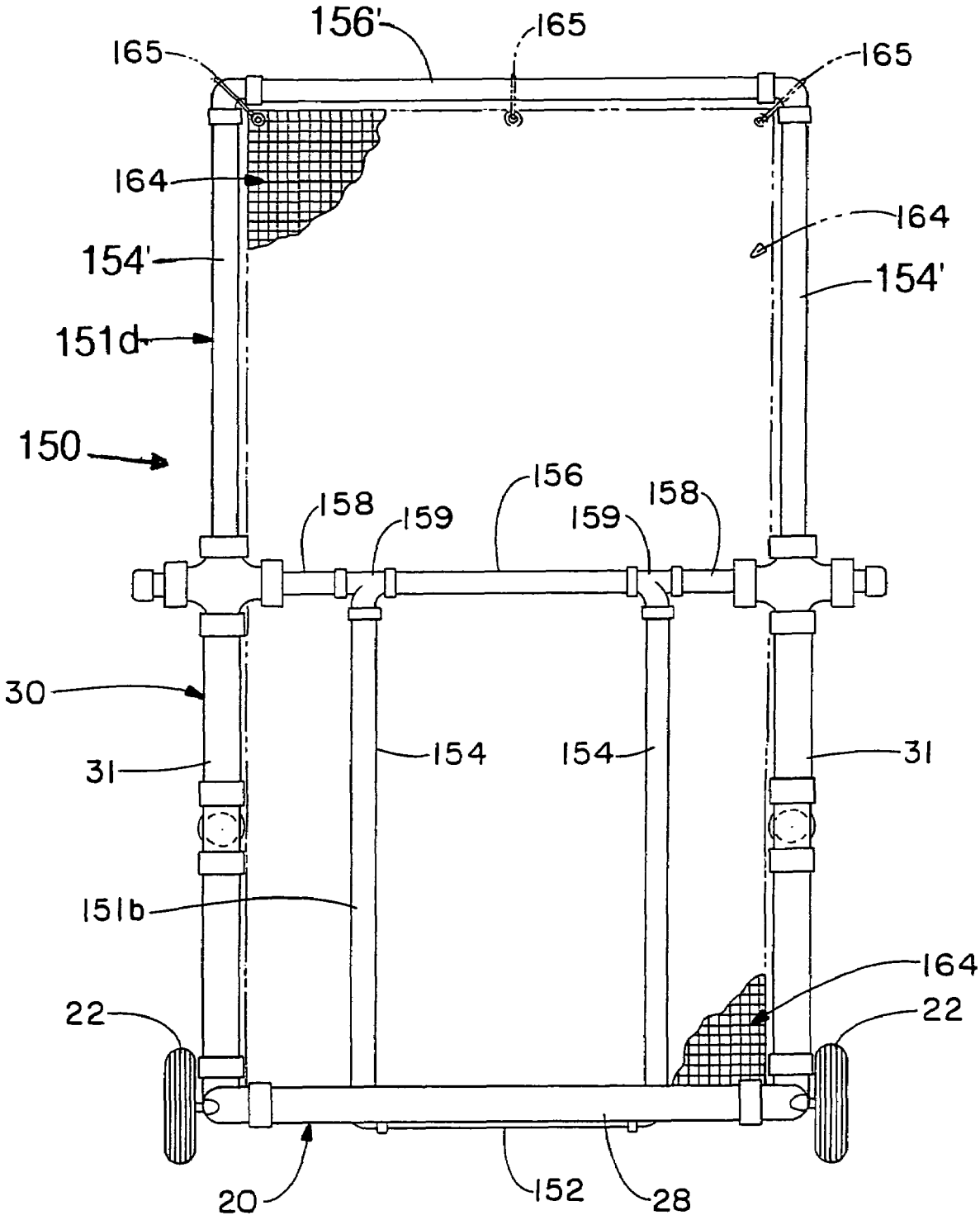
FIG. 10 is a front view of an embodiment of the invention, including a net.

In a further embodiment of the present invention as illustrated in FIGS. 8 through 13, training device 150 can be utilized to practice the kicking aspects of the game, such as punting or field goal kicking, or even snapping for the kicking game or even the "shotgun" formation. Accordingly, in one embodiment, as illustrated in FIGS. 8 through 10, training device 150 includes a target or gate 151 through which a football or other object can be moved, i.e., snapped, kicked, thrown, or the like. Target 151 serves as an aiming area for a football player.

Target 151 preferably includes a lower segment 152 and upper segment 156 and side segments 154 which interconnect the upper segment 156 through connector 159 and lower segment 152. In some embodiments, portions of the training device such as base 30 or a vertical section 31 may serve as a part or portion of target 151. Target 151 preferably has a closed perimeter when viewed from the front as shown in FIGS. 8 and 10. In a preferred embodiment, targets 151 and 151*a-d* are square or rectangular, such as illustrated in FIG. 8 when viewed from the front. However, it is to be understood that target 151 can have other configurations such as a circle, an oval, or any other geometric or non-geometric shape.

Training device 150 can be provided with one or more interchangeable targets 151 which can be utilized on base 30 to match the skill level of the user. For example, when practicing snapping of the football, the training device 150 is positioned a predetermined distance behind the snapper or center such as generally from about 1 to about 50 feet, desirably from about 2 to about 25 feet; and preferably from about 3 to about 20 feet, with the front of the device facing towards the center position player. The width between side segments 154 ranges generally from about 12 to about 36 inches, desirably from about 14 to about 32 inches, and preferably from about 18 to about 26 inches. For increasingly skilled players, in different embodiments, the target width can be set at 30 inches wide for a high school or novice player, 26 inches for a collegiate player and 22 inches for a professional player. Side segments 151*b* and 151*c* illustrated in phantom are examples of targets having varying widths. Connectors 159 can be moved appropriately to connect to side segments 151*b* and 151*c*.

The height of the target 151, such as measured as the vertical distance between the lower segment 152 or a base bar 28 and upper segment 156, ranges generally from about 12 to about 96 inches, desirably from about 18 to about 84, and preferably from about 20 to about 36 or about 72 inches. Similarly, the height of the target can be shortened as skill level of the user increases, if desired.

Target 151*d* illustrated in FIGS. 8 through 10 can be utilized to practice snaps for punting or shotgun situations as the football is snapped to a punter or quarterback who is in a standing position. In this embodiment, cross member 158 and target 151*a* are removed from training device 150. Target 151*d* and side segments 154' include vertical section 31 along a length thereof. The lower segment in the case of target 151*d* is formed by base bar 28. Upper segment 156' spans and connects side segments 154'. An object of embodiment 151*d* is to improve accuracy of snapping by trying to place a football through the interior portion of target 151*d*.

Training Device 150, as illustrated in FIGS. 8 through 10, is connected to base 20 through support member 30. As described hereinabove, base member 20 provides stability to training device 150 and includes one or more base bars 28 arranged to form a stable platform or frame. As shown in FIG. 9, base 20 optionally includes one or more ground contacting members 29, which are optionally height adjustable in order to level the training device 150 as desired. The configuration of ground contacting member 29 is sufficient to provide a plane formed by targets 151*a* through 151*d* with a desired angle with respect to vertical, which is preferred with the targets being situated substantially vertically. As also described hereinabove, the base 20 preferably includes one or more wheels 22 connected via an axle 23 in order to easily position, move, or transport training device 10. A cross section 32 is used to connect two vertical sections 31 to further provide stability.

As illustrated in FIG. 9, training device 150 base 30 extends beyond the plane of target 151 in the forward and rearward directions to provide a solid foundation and thus prevent the training device 150 from tipping or falling over during use. Strength of the training device 150 is also increased by providing the target with a stabilizing support located at a distance of greater than about 20%, about 25%, about 40%, or about 50% above lower segment 152 or base bar 28. FIG. 9 illustrates cross section 32 connected to target 151 at about 50% of the height of target 151 above base bar 28.

Cross member 158 extends between and is operatively connected to two vertical sections 31 as illustrated in FIG. 8. Cross member 158 extends through connector 159 of target 151. As illustrated, a portion of cross member 158 forms upper segment 156 of targets 151*a*, 151*b*, and 151*c*. Cross member 158 is free to rotate on support member vertical sections 31 to cushion any contact from a football or other object.

In a further embodiment as illustrated in FIG. 10, training device 150 of the present invention includes a net 164 which is secured to device 50 utilizing a fastening element 165 such as ties. Net 164 is provided in order to stop, capture or otherwise control a football or other object thrown at training device 150 within the frame structure thereof. In one embodiment, as shown in FIG. 10, net 164 extends within the area of a target such as 151*d*. In a further embodiment as also illustrated, the net 164 can have a larger area and thus extend beyond the perimeter of a target such as 151*b*. With the second embodiment, net 164 is able to stop an errant throw which is not within the perimeter or frame of target 151. Net 164 can be formed with any suitable material, can be woven or non-woven, natural or synthetic, or combinations thereof.

Figure 11:
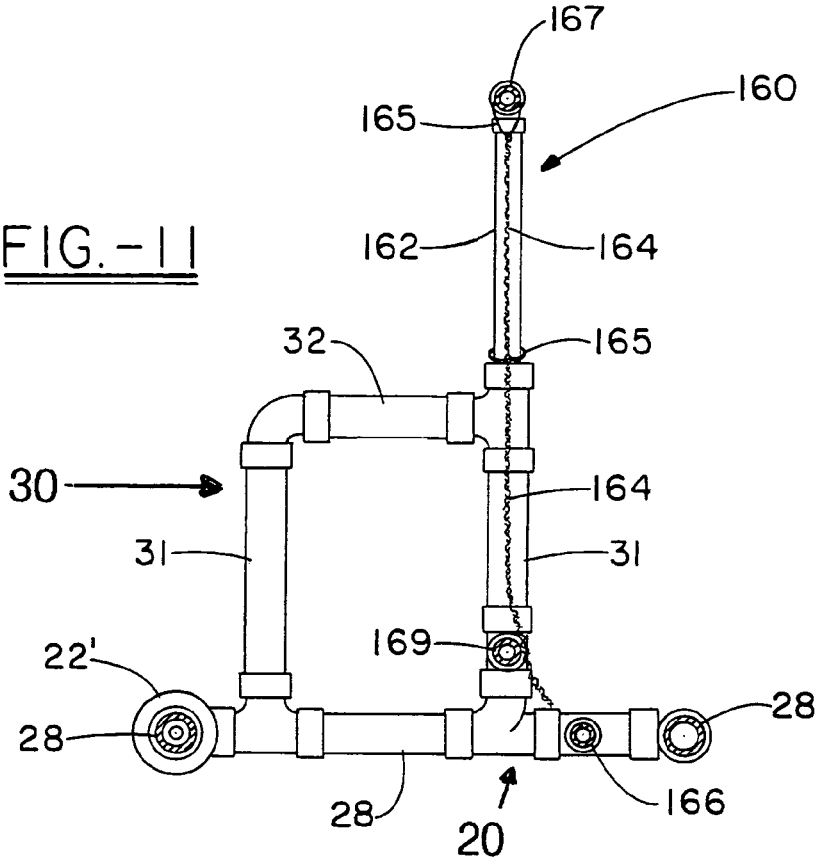
FIG. 11 is a side elevational view of a net device of the present invention with the side nearest the viewer broken away so that the net may be seen.
Figure 12:
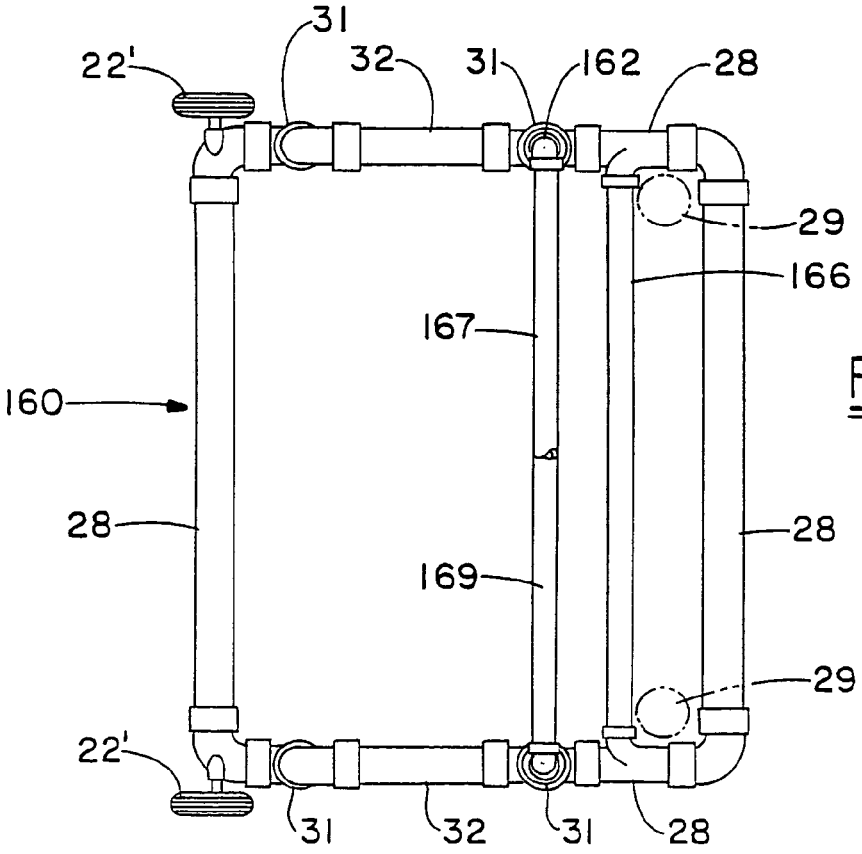
FIG. 12 is a top view of the net device shown in FIG. 11 with the upper crossbar broken away to show the lower crossbar.
Figure 13:
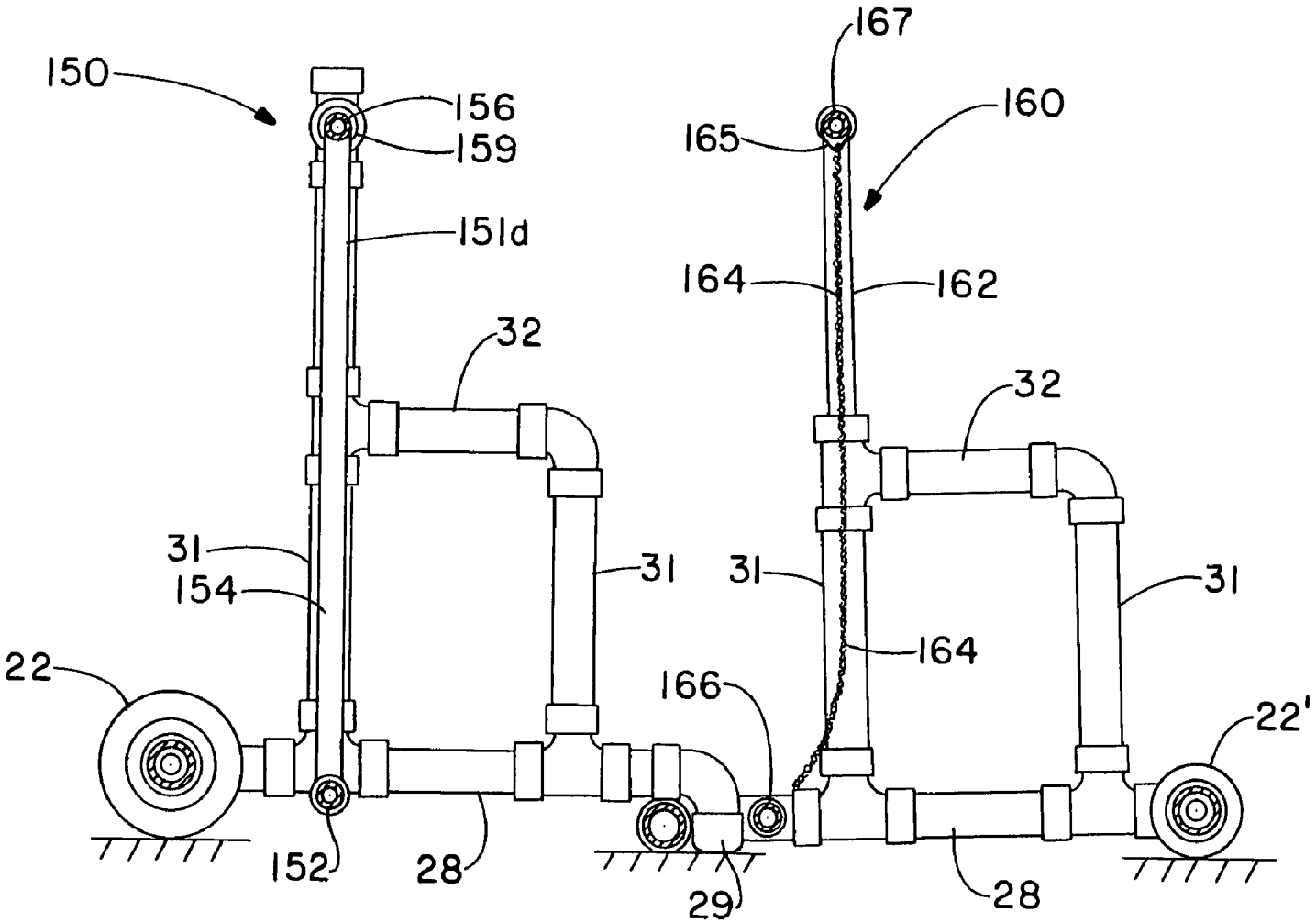
FIG. 13 is a side elevational view showing the practice target or gate unit connected to the net device of the present invention.

In a further embodiment of the present invention, a net device 160 is provided. Net device 160 can be utilized alone, or in combination with another training device, such as training device 10 or training device 150 as described hereinabove. In a preferred embodiment, the net device 160 is operatively connected or used in conjunction with training device 150. The features of net device 160 are illustrated in FIGS. 11 through 13. Net device 160 includes base 20, as described hereinabove, which provides a stable support or frame which is adapted to rest upon a ground surface either through wheels 22' and/or another base portion, such as base bar 28 or connection member 166 whose function will be further explained hereinbelow. Support members 30 are connected to base 20 via a suitable connection element at various locations along the base to base bar 28. Vertical section 31 of support member 30 forms a portion of net frame 162 as shown in FIG. 11. The net frame 162 includes side members 168, upper crossbar 167, and lower crossbar 169, as illustrated in FIGS. 10 and 11. Net 164 is located within net frame 162 and attached by fastening elements 165, such as ties, or the like. Net 164 can be of any desired construction and can be tightly stretched between adjacent frame members, or loose fitting such as found in a typical fish landing net, so that a ball can be captured by the net 164. Net 164 extends to substantially all areas of net frame 162 as illustrated in FIG. 11.

Net frame 162 when viewed from the side, such as shown in FIG. 11, has a substantially planar side profile which ranges from about 0° to about 45° with respect to vertical. That is, the angle of net frame 162 can be adjusted as desired, such as by utilizing a longer or shorter cross section 32 in order to place net frame 162 at an angle desired for training. In a preferred embodiment, the net frame 162 is angled from about 0° to about 20° with respect to vertical. The greater the net frame angle away from vertical, the greater ability the net device 160 provides to knock down a football or other object, kicked, thrown, or the like there at.

FIG. 12 is a top view of the net device 160 of the present invention. As illustrated, net frame 162 is located at a position intermediate base bars 28. A portion of upper crossbar 167 is cut away to show lower crossbar 169. Net device 160 includes connection member 166 which extends between opposite base members 28 as shown. In a preferred embodiment, the net device 160 is adapted to be operatively connected to training device 150 as illustrated in FIG. 13. Ground contacting members 29 of training device 150 are adapted to be inserted between connection member 166 and parallel base member 28 in order to provide a desired alignment between training device gate 150 and net device 160. As illustrated in FIG. 13, a portion of training device 150, including ground contacting member 29, is inserted over base member 28 of net device 160 to provide the operative connection between devices 150 and 160. As illustrated, the plane of target 151*d* of training device 150 is substantially parallel to the plane of net frame 162 of net device 160.

Figure 14:
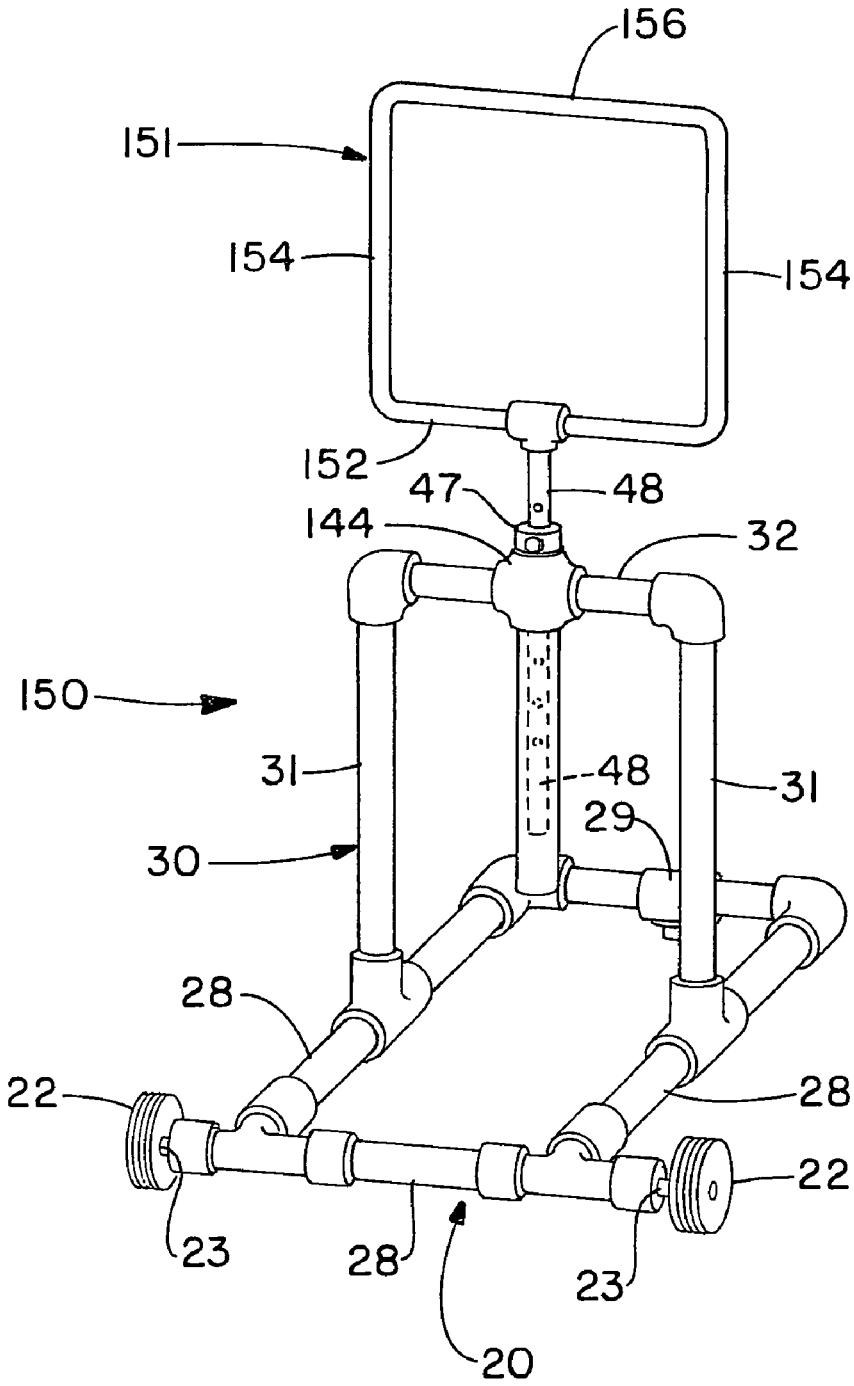
FIG. 14 is a perspective view showing an alternative embodiment of the practice target or gate unit connected through a substantially horizontal crossbar of the support member.

FIG. 14 illustrates yet a further embodiment of training device 150 of the present invention. Therein, target 151 is shown in a position above substantially horizontal cross section 32 as described hereinabove, target 151 includes a lower segment 152, upper segment 156, and side segments 154 which interconnect the upper and lower segments. Target 151 preferably has a closed perimeter as shown. In the embodiment illustrated in FIG. 14, target 151 is connected to tube 48 as described hereinabove. In a preferred embodiment, tube 48 can be connected through figure connection member 144 at a plurality of different heights as desired by the user. Training device 150 is connected to base 20 through support member 30, such as described hereinabove. Target 151 can be fixed or is otherwise allowed to rotate within figure connection member 144 utilizing tube 48. The embodiment shown in FIG. 14 is preferably utilized as a training device for passing, wherein a football player attempts to throw the football between or at target 151. Alternatively, as described hereinabove, tube 48 can be connected to FIG. 40.

In one embodiment, the training device 150 and net device 160 can be utilized as follows. A football player such as a center would line up to the left of devices 150 and 160 as illustrated in FIG. 13. The football player would then snap the football towards training device 150 attempting to place the football within frame 151*d* when attempting a snap for the punting game or a shotgun formation. A football thrown through target 151*d* would be stopped by netting device 160, especially net 164 thereof. The football would then be retrieved for additional practice. As can be imagined from the arrangements shown in the drawings, when a different target is utilized, different aspects of the football training can be performed.

In accordance with the patent statutes, the best mode and preferred embodiment have been set forth, the scope of the invention is not limited thereto, but rather by the scope of the attached claims.

What is claimed is:

1. A football training device, comprising:

a base adapted to contact a ground surface, a first frame comprising a) a first vertical section, b) a second vertical section extending substantially vertically upward from the base, and c) a cross member directly connected to and extending between the first vertical section and the second vertical section, and a target forming a second frame located within a perimeter of the first frame and operatively connected to the cross member, the target comprising an upper segment and two side segments connected to the upper segment, wherein the target side segments are located between the first frame first vertical section and second vertical section and the target side segments extend downwardly below the upper segment, wherein the side segments are spaced apart from the first frame first vertical section and second vertical section wherein the target is an aiming area, the target upper segment is part of the first frame cross member, wherein each side segment of the target is connected to the cross member by a connector, wherein each connector is movable laterally on the cross member to adjust width of the target between the side segments spaced between the first frame first vertical section and second vertical section, wherein a net device is operatively connected to the training device, wherein the net device includes a net frame, wherein a net is connected to the net frame, wherein the net frame includes first and second side members spaced a distance from each other and connected by an upper crossbar, wherein the distance between the net frame side members ranges from about 12 to about 48 inches, wherein the net frame is connected to a base of the net device wherein the net base includes a net base bar and a net connection member spaced a distance from each other and each connected to base bars that are connected to the first and second side members of the net frame, wherein the base connected to the first frame has a ground contacting member that extends over the net base bar and is inserted between the net frame connection member and net frame base bar and adapted to contact the ground surface thereby providing operative connection between the device including the first frame and target and the net frame device wherein the net of the net frame is spaced a distance from the target.

2. The device according to claim 1, wherein the distance between first and second side segments of the target range from about 12 to about 36 inches.

3. The device according to claim 2, wherein the target has a height of about 12 to about 96 inches.

4. The device according to claim 3, wherein a net is connected between the first and second side segments of the first frame.

5. The device according to claim 1, wherein a net is connected between the first and second side segments of the first frame.

6. The device according to claim 1, wherein a target lower segment is connected between lower ends of the side segments of the target.

7. The device according to claim 1, wherein a third vertical section and fourth vertical section are present on the device with an end portion of each of the third vertical section and the fourth vertical section connected to the base, and wherein a cross section connects the third vertical section and the fourth vertical section independently, to either the first vertical section or the second vertical section to provide stability to the training device.

8. The device according to claim 6, wherein the first vertical section and second vertical section extend above the cross member and are connected above the cross member by a second upper segment.

9. The device according to claim 8, wherein the base includes a plurality of base bars that are connected to provide stability to the base.

10. The device according to claim 2, wherein the distance between the first and second side segments of the target are from about 14 to about 32 inches.

11. The device according to claim 10, wherein the distance between the first and second side segments of the target are from about 18 to about 26 inches.

12. The device according to claim 3, wherein the target has a height of about 20 to about 72 inches.

13. A football training device, comprising:

a base adapted to contact a ground surface, a first vertical section and a second vertical section extending substantially vertically upward from the base, a cross member connected to and extending between the first vertical section and the second vertical section and a target operatively connected to a figure connection member connected to the cross member, the target comprising a height adjustment tube, wherein the tube can be connected to the figure connector member at a plurality of different heights, wherein the tube is connected to a spin collar of the figure connection member so that the target is allowed to rotate in relation to the base at each of the plurality of heights, and wherein the target has a closed perimeter comprising a lower segment, an upper segment, and side segments each connected to the lower support and the upper support.

14. The device according to claim 13, wherein the tube has a plurality of apertures spaced at vertical heights to allow height adjustment of the tube in relation to the cross member, wherein the base includes one or more wheels connected via an axle.

15. The device according to claim 13, wherein the tube has a plurality of apertures spaced at vertical heights to allow height adjustment of the tube in relation to the cross member.

* * * * *